US006918567B2

(12) United States Patent
Ward et al.

(10) Patent No.: US 6,918,567 B2
(45) Date of Patent: Jul. 19, 2005

(54) CONCRETE PANEL WITH GRIPPING RIBS AND METHOD OF USE

(75) Inventors: Philip T. Ward, Leawood, KS (US); Larry D. Austin, Independence, MO (US)

(73) Assignee: Western Forms, Inc., Kansas City, MO (US)

( * ) Notice: Subject to any disclaimer, the term of this patent is extended or adjusted under 35 U.S.C. 154(b) by 150 days.

(21) Appl. No.: 10/360,398

(22) Filed: Feb. 7, 2003

(65) Prior Publication Data

US 2004/0079859 A1 Apr. 29, 2004

Related U.S. Application Data

(60) Provisional application No. 60/420,807, filed on Oct. 23, 2002.

(51) Int. Cl.[7] ..... E04G 9/06; E04G 11/36

(52) U.S. Cl. ..... 249/4; 249/7; 249/189

(58) Field of Search ..... 249/189, 190, 249/40, 2, 3, 4, 5, 7

(56) References Cited

U.S. PATENT DOCUMENTS 5,922,236 A * 7/1999 Zuhl ..... 249/34
6,021,994 A * 2/2000 Shartzer, Jr. ..... 249/6
6,581,898 B2 * 6/2003 McCracken ..... 249/189

OTHER PUBLICATIONS

Western Forms, Inc. Catalog titled "World's Leading Innovator in Aluminum Forming Systems" copyright 1999, all pages.

* cited by examiner

*Primary Examiner*—Michael Safavi
(74) *Attorney, Agent, or Firm*—Hovey Williams LLP

(57) ABSTRACT

A concrete forming panel and its method of use is provided wherein the forming panel has a face plate including a frame, a front side and a back side, and one or a plurality of pairs of ribs which extend longitudinally along the back side. The pairs of ribs are provided sufficiently closely together to grip an element passing through the face plate or to grip a wedge which in turn engages the element. The element may be a nail, stake, or other fastener used to hold the forming panel in the ground, to connect the forming panel to other forming panels, or to indicate a desired level for concrete poured against the front side to be cured and hardened into a finished structure, such as a foundation for a building. The ribs may be provided with slots for receiving a reinforcing element of a relatively harder material, and the reinforcing element may be shiftably received in the slot so that its position may be changed as the reinforcing element wears during use.

23 Claims, 4 Drawing Sheets

CONCRETE PANEL WITH GRIPPING RIBS AND METHOD OF USE

RELATED APPLICATION

This application relates to and claims the benefit of priority of prior copending U.S. Provisional Application No. 60/420,807, filed Oct. 23, 2002, said Provisional Application being hereby incorporated by reference into the present specification.

BACKGROUND OF THE INVENTION

1. Field of the Invention

This invention relates to a concrete forming panel which includes a forming face which has a reinforcement on the rear side of the forming face adapted for gripping elements removably attached thereto. The reinforcement is configured to resist expansion of openings through the forming face. More particularly, it is concerned with a concrete form and method of its use in connection with the pouring of low concrete walls or pads where the form may be held in place by stakes driven into the ground.

2. Description of the Prior Art

The formation of concrete walls and pads is well known and often involves the use of wooden or metal forms. Metal forms are more expensive, but also more durable and may be repeatedly used. When concrete pads are to be poured in residential construction, there is a need for concrete forms which can be quickly and economically set up and dismantled for use at the next site. Examples of known forming panels include those shown in U.S. Pat. Nos. 4,708,315, 4,958,800, 5,058,855, 5,184,439 and 5,965,053, the disclosures of which are incorporated by reference herein.

One problem especially presented by the use of metal forms for pouring foundations such as concrete pads involves their use on rough ground. The metal forms have a permanent shape, and there is a desire to avoid permanently altering or damaging the forms by drilling openings to receive tie rods, bars or tensioning cables therethrough, or driving nails through the frame or face plate of the form to indicate level lines so that the concrete can be poured to a desired depth with a level, horizontal surface. Also, rocks, stumps or other solid objects maybe buried just below grade, and stakes conventionally used for anchoring the forms may encounter such objects are particularly presented in using concrete forms for form.

In addition, it is known to post-tension concrete slabs by the use of such tensioning cables. Post-tensioning concrete slabs uses tensioning cables surrounded by sheaths which are positioned in the pouring area and after the poured concrete is hardened, stretching the cable by applying tensioning at the ends through the use of a stressing jack and then anchoring the cable ends in the concrete. Such a practice improves the response of the resulting concrete slab to loading, and reduces deflections and cracking. Further, the use of post-tensioning in concrete slabs may result in slabs which are generally thinner, relatively longer, and reducing the weight of the resulting poured structure. However, in order to initially position the live end anchor which is typically received within a cone to create a pocket for access after concrete hardening and the dead end anchor which is encased within the hardened concrete, it has been heretofore largely necessary as a practical matter to employ wooden forms which must be discarded after use.

There is thus a need for an improved concrete forming panel and method of use which overcomes these problems.

SUMMARY OF THE INVENTION

These and other needs are largely met by the concrete forming panel of the present invention. That is to say, the concrete forming panel hereof is particularly useful in forming foundations such as concrete pads where it is desirable to anchor the forming panel to the ground by stakes, and wherein the forming panel may need to be penetrated through the front side of the face plate. To this end, the concrete forming panel hereof includes at least one and preferably a plurality of sets of reinforcing ribs on the back side of the face plate which are configured and position for gripping a variety of elements passing through the face plate, either themselves or with the use of wedges depending on the orientation of the element relative to the front side of the face plate.

Broadly speaking, the concrete forming panel of the present invention includes a face plate having a frame, a front side and a rear side, and at least one set of reinforcing ribs received on the back side, the ribs being positioned closely adjacent one another and parallel for gripping objects placed therebetween. The face plate may be formed with a face panel having the front side and rear side which is separate from the frame, or a portion of the frame may be cast by extruding or the like or forged so that the face panel is integral with some of the rails and the reinforcing ribs. The elongated reinforcing ribs preferably extend longitudinally along the back side of the face plate, but alternatively or in addition may extend along the frame. The face plate and the ribs are preferably provided of aluminum, which as used herein includes both elemental aluminum and alloys wherein the primary constituent is aluminum. Because aluminum is relatively soft and subject to wear, the ribs may include longitudinally extending slots which receive therein reinforcing elements of a harder material, such as steel. Most preferably, the reinforcing elements are shiftably received in the slots, thereby permitting the reinforcing elements to be moved along the slots to vary the locations where wear occurs and also permitting the reinforcing elements to be located to engage an element to be gripped.

The face plate is preferably provided with opposing top and bottom rails, and at least one set of holes in the frame on each of the top and bottom rails. A stake may be placed through one of the holes of each set, so that the stake penetrates the ground and holds the forming panel in place. The stake may be positioned perpendicular or skew to the rails to avoid rocks or other impediments to penetration into the soil. The ribs may themselves engage the stake, or more preferably a wedge may be placed between the ribs and engage the stake to secure it and therefore the form in the desired placement. The wedge may be driven into engagement with the stake by a hammer or the like, whereby the face plate is firmly held in place. Two or more stakes may be used to resist movement of the forming panel.

It may also be desirable to provide openings in through the face side of the face plate for the passage of tie rods, anchoring cables or the like. After their use, the openings would permit leakage of concrete therethrough. However, the forming panel of the present invention permits these holes to be plugged through the use of elements such as plugs or the like which may be gripped by the ribs. This not only permits the forming panel to be reused, but permits removal of the elements as desired when it is again necessary to use the opening.

Further, it may be desirable to penetrate the face plate during its use. Because the face plate is preferably provided of aluminum, a nail or other fastener may be driven through the face plate so that it passes between the ribs. The nail may be used to connect the forming panel to lumber on a face of the forming panel or to wood forming panels, reinforcements or stakes. This may be especially advantageous where tensioning cables are used to hold spaced-apart and opposed panels in position during the pouring and curing of the concrete, and there is a need to attach the cable to the panel.

These and other advantages will be readily apparent to those skilled in the art with reference to the drawings and the description of the preferred embodiment which follows.

DESCRIPTION OF THE PREFERRED EMBODIMENT

Figure 2:
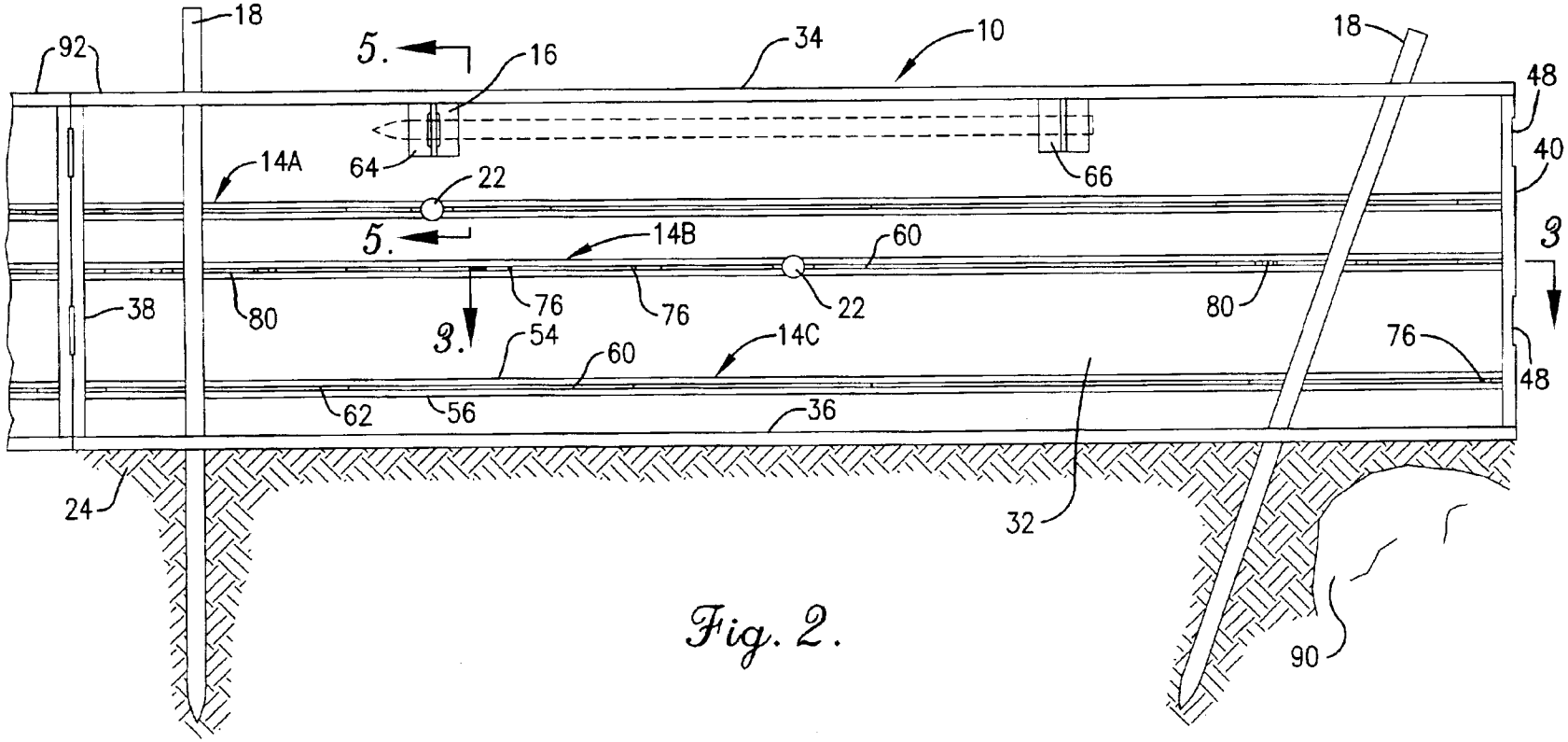
FIG. 2 is a rear elevational view thereof, showing one of the stakes perpendicular to the upper rail and another stake skew thereto, and showing in dashed lines the position of a stake when held by a hanger on the forming panel.

Referring now to the drawings, a forming panel 10 for use in forming structures from flowable cementatious material such as concrete broadly includes a face plate 12 and at least one, and preferably a plurality of pairs of, reinforcing ribs 14. A hanger 16 may be provided for holding a steel stake 18 used with the forming panel 10. A fastening element 20 may be used with the forming panel 10, and one or a plurality of plug elements 22 may be used to close openings in the face plate 12. As shown in FIG. 2, the forming panel 10 is particularly useful for forming foundations such as concrete pads which rest directly on the ground 24.

In greater detail, the face plate 12 is preferably fabricated of an aluminum alloy such as ASTM 6061 T-6, and includes a frame 26 and a face panel 28 having a front side 30 and a back side 32. The frame 26 preferably includes a top rail 34 and a bottom rail 36, and first and second side rails 38 and 40 which together with the back side 32 of the face panel 28 define a rear area 41 inwardly of the margins of the rails. The face panel 28 may be formed separately and welded to the frame 26, or alternatively as shown in the drawings, the face panel 28 and top and bottom rails may be integrally formed by casting, such as extrusion, and the side rails 38 and 40 then welded to the extrusion. The frame 26 including the rails is fabricated of a greater thickness of material along at least some parts thereof than the face panel 28.

Figure 1:
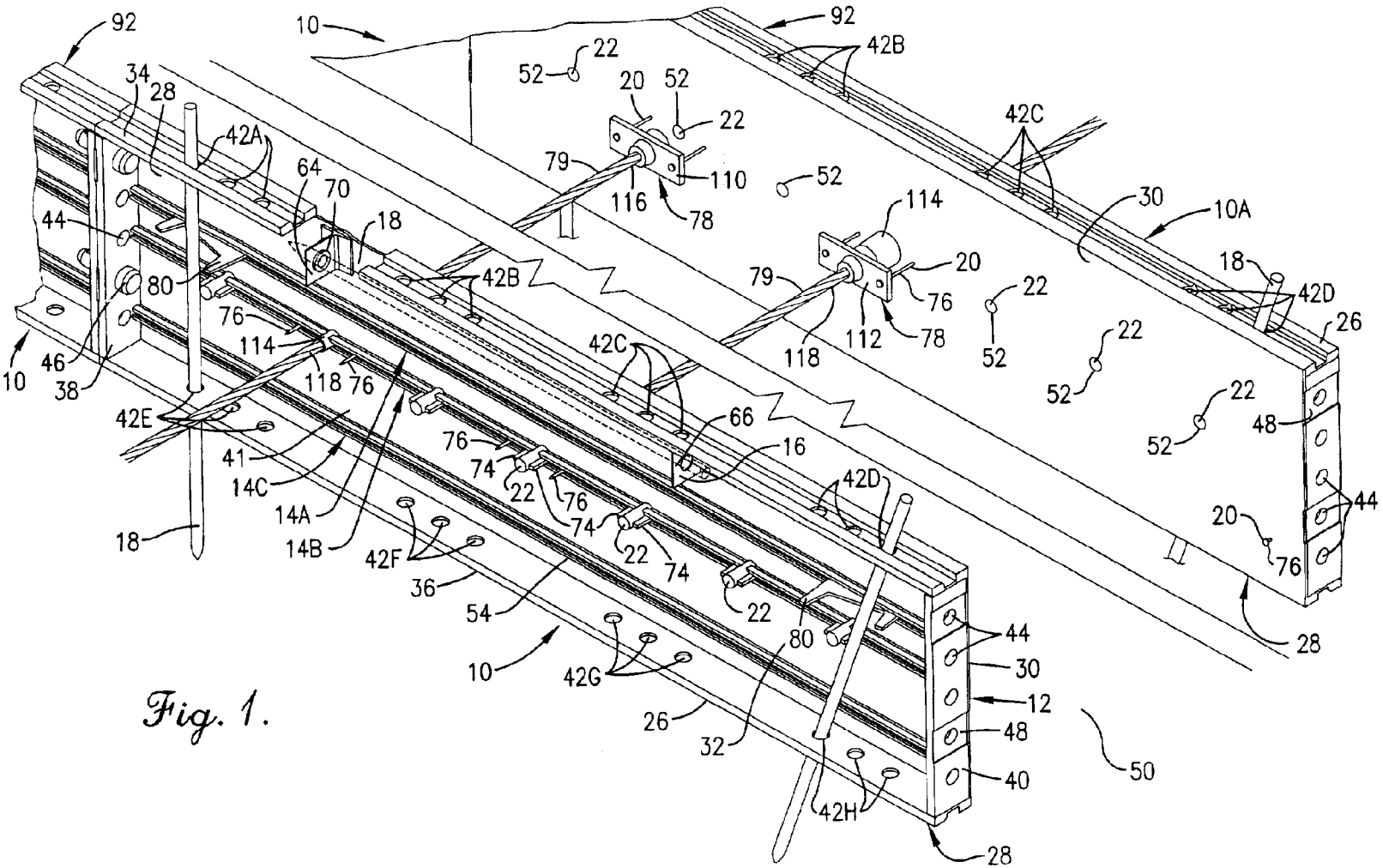
FIG. 1 is a rear perspective view of a concrete forming panel in accordance with the present invention, showing the reinforcing ribs along the back side of the face plate, the concrete forming panel being anchored to the ground by stakes and connected to and opposing other forming panels by live end and dead end anchors and tensioning cables passing through a pouring area between the forming panels for receiving flowable concrete for curing and hardening.

The top rail 34 and the bottom rail each include at least one, and preferably a plurality of sets 42 of holes 44 therethrough. As used herein, a set 42 of holes 44 is meant to mean a plurality of holes 44 more closely spaced together than the distance between holes 44 of different sets 42. As shown in FIG. 1, the top rail 34 thus includes four sets 42A, 42B, 42C and 42D of three holes 44 each, and the bottom rail 36 includes four sets 42E, 42F, 42G and 42H of three holes 44 each, the set 42A being positioned in registry above and opposite the set 42E, and the same respective relationship existing between set 42B and 42F, set 42C and 42D, and set 42D and 42G.

In addition, the side rails 38 and 40 are each provided with a plurality of holes 44 for receiving therethrough couplers, such as pins 46 and their associated wedges for coupling the forming panel 10 to similar or compatible adjacent forming panels as shown in FIGS. 1 and 2. Furthermore, the side rails 38 and 40 may include recesses 48 on their outer surface which, in some applications, may facilitate the receipt of tie bars or the like which may be secured by pins 46 for connecting the forming panel 10 to an opposite forming panel 10A or to an adjacent forming panel. A pouring area 50 into which flowable concrete maybe poured is located between opposed forming panels 10 and 10A for forming the structure between front sides of the opposing face panels. The face panel 28 may be smooth or textured on its front side 30, texturing being provided to form a pattern to be imparted to the concrete hardening thereagainst, such as a brick pattern.

Figure 5:
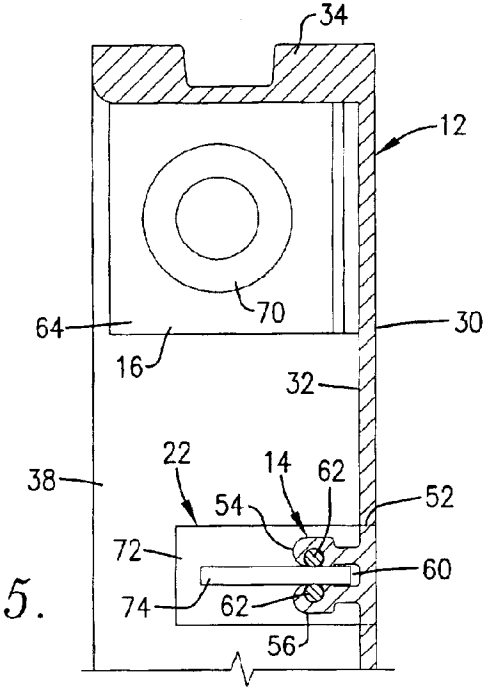
FIG. 5 is an enlarged, fragmentary vertical cross-sectional view taken along line 5—5 of FIG. 2, showing the plug element gripped by a pair of ribs and a hanger for retaining the stake prior to use, the hanger including an elastomeric grommet.
Figure 4:
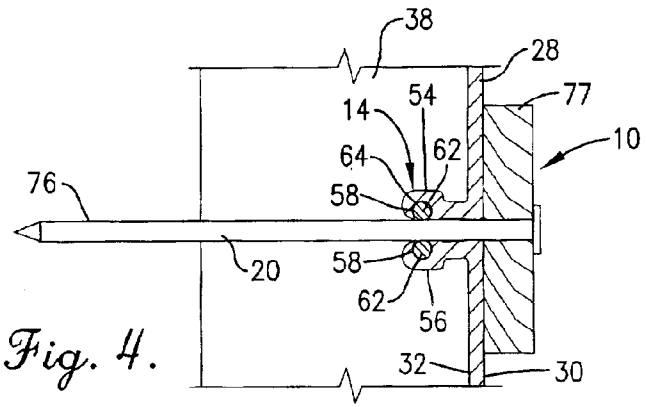
FIG. 4 is an enlarged, fragmentary vertical cross-sectional view taken along line 4—4 of FIG. 3, showing a nail fastener penetrating through the front side of the face plate and gripped between one of the pairs of reinforcing ribs for attachment of wood blocks or the like to the panel.

The pairs of reinforcing ribs 14 preferably extend longitudinally across the back side 32 and may either extend the width of the form between the side rails 38 and 40 as shown with respect to the pair of reinforcing ribs 14C, or may be interrupted by openings 52 in the face panel 28 as shown by pairs of reinforcing ribs 14A and 14B as described below. Each pair of ribs 14 includes an elongated first rib 54 and an elongated second rib 56 which are preferably mirror images and cantilevered from the back side 32 of the face panel 28. The ribs 54 and 56 may be cast by extrusion or the like as a part of the face plate 12 as shown in FIGS. 4 and 5, or may formed separately and secured by welding, brazing or the like to the face panel 28.

Each of the ribs 54 and 56 preferably includes a longitudinally extending slot 58 which faces the opposite rib and the gap 60 therebetween, so that the slot 58 communicates with the gap 60. The gap 60 is preferably less than about 25 centimeters across between the ribs in order that the ribs 54 and 56 of each pair 14 may grip elements received therebetween. One or a plurality of reinforcing elements 62 are preferably of a shorter length than the ribs and thus slidably received in the slot 58 which permits the reinforcing elements 62 to be shifted longitudinally along the slot.

The reinforcing elements 62 are preferably steel rods 64. Aluminum has a much lower hardness than steel (about 30 on the Brinnell hardness scale (Bhn) for cold rolled ASTM 6061 aluminum versus a Bhn number of about 111 for hot rolled SAE 1020 steel and a Bhn of 179 for hardened, tempered SAE 1020 steel). Thus, the use of the steel reinforcing element 62 greatly reduces wear on the ribs. The use of steel for the reinforcing element 62 also provides increased strength to the rib 54 or 56 to which it is attached. For example, ASTM 6061 aluminum has a tensile strength of about 20,000 to 40,000 psi and a yield strength of about 8,000 psi, whereas hot rolled SAE 1020 steel has a tensile strength of about 55,000 psi and a yield strength of about 30,000 psi and hardened, tempered SAE 1020 steel has a tensile strength of about 90,000 psi and a yield strength of about 60,000 psi. A particularly preferred steel for use as the wear element is an ASTM-228-93 steel wire having a tensile strength of about 254,000 psi to about 259,000 psi and a Bhn of about 518 to 529.

The hanger 16 is provided for retaining the stake 18 in place on the form when form 10 is not in use. The hanger 16 is typically provided of two aluminum brackets 64 and 66 longitudinally spaced along the back side 32 and secured thereto by welding, brazing, rivets or the like, each having a passage 68 of sufficient size to receive the stake 18 therethrough as shown in FIGS. 1 and 2. At least one of the brackets 64, 66 includes an elastomeric grommet 70 of synthetic resin or rubber to grip and hold the stake.

Figure 3:
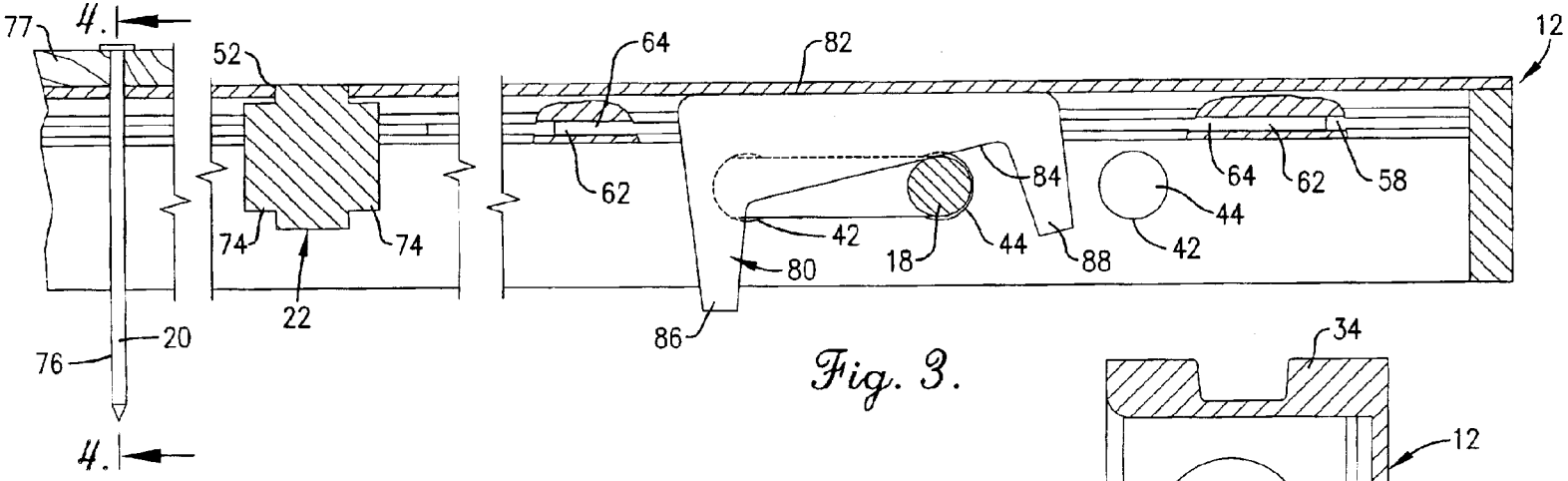
FIG. 3 is an enlarged, fragmentary horizontal cross-sectional view taken along line 3—3 of FIG. 2, showing the receipt of a plug element in an opening extending through the face panel of the face plate, a reinforcing rod received in a slot in the reinforcing ribs, and a wedge gripped between the ribs.

As shown in FIGS. 3, 4 and 5, the pairs of reinforcing ribs 14 are configured to grip elements received in the rear area 41. Openings 52 may be provided in the forming panel 10, preferably along the longitudinal length of the pairs of reinforcing ribs 14, to permit the use of tie rods or cables which must pass through the face plate 12. When it is desired to block or close an opening 52 in the face plate 12 which extends from the front side 30 through to the rear side 32, a plug element 22 may be held by the opposing ribs 54 and 56. The plug 22 preferably is provided of aluminum or other durable material, but may also be provided of synthetic resin or rubber and includes a central, substantially cylindrical body 72 and wings 74 extending diametrically opposite therefrom. The body 72 may be placed in the opening 52 with the ribs 54 and 56 holding the wings 74 as shown in FIGS. 1, 2, 3 and 5.

The pairs of reinforcing ribs 14 are also useful to grip a fastening element 20, such as a nail 76 driven through the face plate 12. The nail 76 penetrates the face plate 12 which is typically of aluminum, and then may be gripped between the rods 64 as shown in FIG. 4 to provide steel-to-steel contact and thus avoid wear to the face plate 12, the cantilevered arrangement of the ribs 54 and 56 permitting them to yield and thus grip the nail. Nails 76 or other fastening elements 20 are useful if a piece of wood 77 needs to be attached to the forming panel 10, or when an anchor 78 is used when a tensioning cable 79 received in a surrounding sleeve (not shown) is passed through the pouring area and connected to the anchors 78 for anchoring an end of the cable 79. The head of the nail 76 may be exposed to facilitate removal of a piece of wood or the anchor. The provision of several pairs of reinforcing ribs 14A, 14B and 14C is especially useful for receiving and gripping nails 76 at different heights for different depths of concrete.

In addition, the pairs of reinforcing ribs 14 are particularly useful in connection with fixing the reinforcing panel 10 relative to the stakes 18. The position of the holes 44 in each set 42 causes the stakes to pass through the rear area 41. Retaining elements such as wedges 80 of mild steel or other suitably hard material may be provided for receipt in the gap and gripping by the ribs 54 and 56. The wedges 80 are shown in detail in FIG. 3 and are preferably flat and of a thickness complemental to the gap 60.

The wedges have a front margin 82 and a back margin 84 which is at an acute angle relative to the front margin. Fingers 86 and 88 are located along the sides of the wedge 80 and extend toward the back margin 84 to aid in placement of the wedge in the gap and permit driving of the wedge 80 longitudinally along the pair of reinforcing ribs 14 which receives it. The depth between the front margin 82 and back margin 84 thus varies as shown in FIG. 3, whereby a stake received in the holes 42 may initially pass by the narrowest part of the wedge 80, and the wedge then driven longitudinally along the pair of reinforcing ribs 14 receiving it until the back margin 84 engages the stake 18 as shown in FIG. 3. Because the holes 42 have a greater diameter than the diameter of the stakes 18, the stake may be angled to avoid rocks 90 in the ground as shown in FIG. 2, but the forming panel 10 may nonetheless remain fixed to the stake 18 whether the stake is substantially perpendicular to the top rail or at an acute angle thereto, each of which is shown in FIG. 2.

Figure 6:
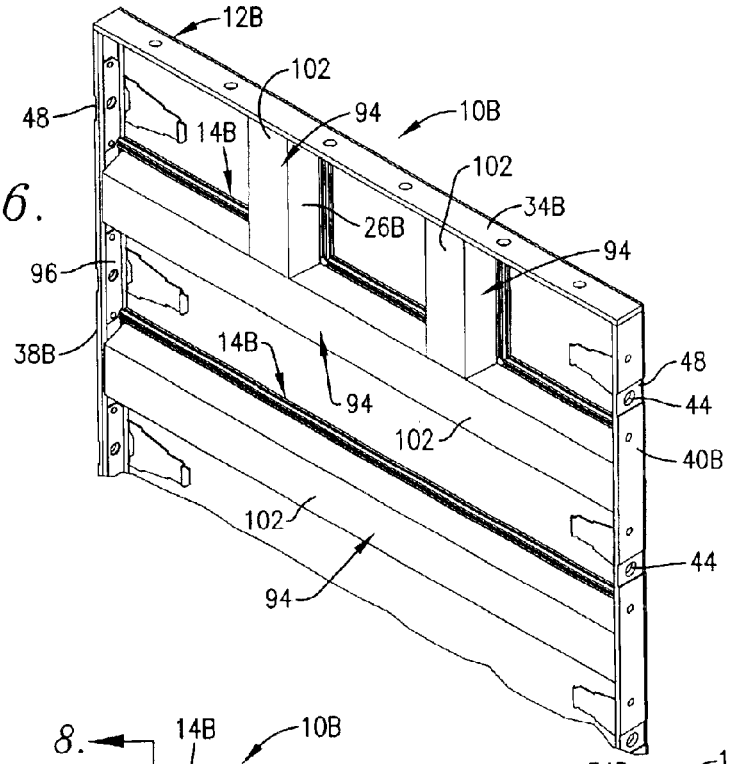
FIG. 6 is a fragmentary rear isometric view of another embodiment of a forming panel constructed in accordance with the principles of the present invention.
Figure 7:
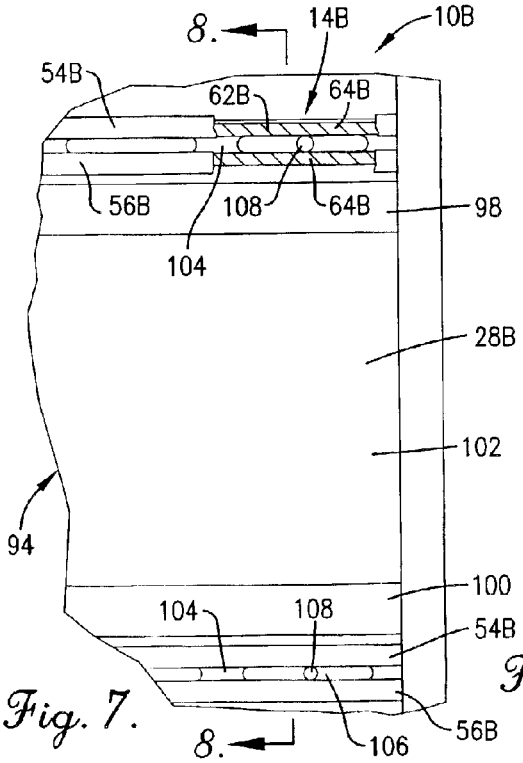
FIG. 7 is a fragmentary rear elevational view of the embodiment of FIG. 6.
Figure 8:
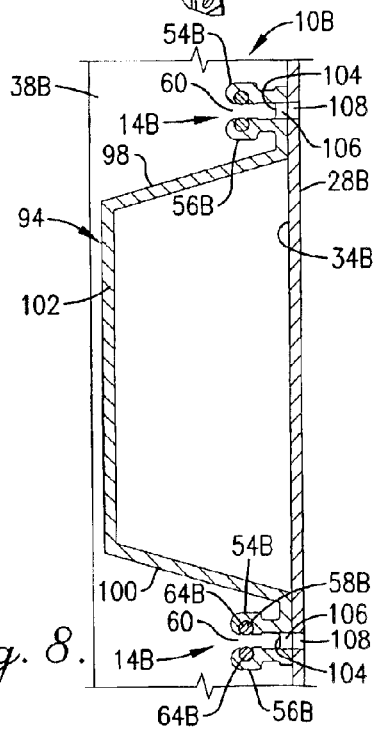
FIG. 8 is a fragmentary vertical cross-sectional view of the embodiment of FIG. 6 taken substantially along line 8—8 of FIG. 7.

FIGS. 6, 7 and 8 illustrate an alternative forming panel 10B in accordance with the present invention, with like numbers used to indicate features common to forming panels 10 and 10A, wherein the face plate 12B includes a frame 26B having first and second side rails 38B and 40B, top rail 34B and a bottom rail (not shown), and wherein the pairs of reinforcing ribs 14B are integrally formed with hats 94. The hats 94 may extend either parallel to the top and bottom rails 34B and 36B or extend perpendicular or at other angles relative to the top and bottom rails as shown in FIG. 6.

The frame 26B may also include reinforcing plates 96 of steel or aluminum alloy which are interior to the rails and serve to reinforce the rails in the vicinity of the holes 44 through the rails. The hats 94 serve to reinforce the face panel 28B against deflecting loads imparted by the cementations material received thereagainst, and preferably include sloping sidewalls 98 and 100 connected by stretch 102. The pairs of reinforcing ribs 14B are preferably integrally formed by extrusion as a part of the hat 94, and as shown in FIGS. 7 and 8, are positioned adjacent each of the sloping sidewalls 98 and 100.

The ribs 54B and 56B are similar in configuration to ribs 54 and 56, but include a web 104 connecting the ribs 54B and 56B. The web 104 lies against the back side 34B of the face panel 28B. The web 104 may be provided with elongated slots 106 at longitudinally spaced intervals therealong to facilitate the passage of fastening elements 20 through the web and the face panel, so that openings 108 created by drilling or driving a nail through the face panel are in registry with the slots 106. Reinforcing elements 62B such as rods 64B are received in slots 58B in each of the ribs 54B and 56B so that the rods 64B oppose one another to grip elements inserted therebetween as described with regard to the forming panel 10.

In use, the forming panels 10, 10A or 10B hereof are assembled into forming walls 92 by the use of couplers, and depending on the distance between opposing forming walls, tie bars, tie rods, cables or other connecting structures may be used to hold the forming walls in the desired shape. When cables or tie rods are used which must pass through the forming panel 10, they pass through the openings 52 in the face plate 12. Otherwise, plugs 22 are used to close the openings, the plugs being held in place by the clamping action of the ribs 54 and 56 of a pair 14.

The wedges 80 are placed at desired locations along the length of the pairs of reinforcing ribs 14 proximate to the desired alignment for the corresponding holes 42 of a particular set 40 where the stake 18 is to pass through. The stake 18 is removed from the hanger 16 and driven into the ground, and then the wedge 18 is driven longitudinally along one of the pairs of reinforcing ribs 14 until it engages with the stake 18. If desired, nails may be driven through the face plate 12 to attach pieces of wood for use as a part of the forming wall or as otherwise needed. Concrete is then poured into the pouring area 50 between the forming walls and against the front side 30. After curing and hardening of the concrete into the pad or other concrete structure, the stakes are pulled and the forming walls 92 are disassembled for reuse.

As shown in FIG. 1, the forming panel 10 is useful in connection with a post tensioning system, where anchors 78 include both dead end anchor 110 and live end anchor 112, and a cone 114 is provided between the live end anchor 112 and the forming panel to create a pocket for access. The cable 79, having a first end 116 connected and fixed to the dead end anchor 110 and a second end 118 which initially passes through the live end anchor 112, extends through the pouring area between the forming panels 10 and through an opening 52 in the face plate. The anchors 78 maybe held in place by nails driven into the form and gripped by the ribs 14 prior to pouring of the concrete. After the concrete is hardened, the forming panels 10 may be removed, the dead end anchor 110 holding the first end of the cable being encased in the concrete. The cable, permited to shift because it is encased within its sheath, then has its second end 118 connected to a stressing jack to apply a tensioning load on the cable 79. This tensioning force is transmitted to both of the anchors when the tensioned cable is fixed to the live end anchor 112. As a result, the tension is then imparted to hardened concrete because the anchors 78 are embedded in the hardened concrete. The cone 114 creating a pocket in the concrete may then be filled and grouted.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame;

a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap; and at least one nail passing through said face plate into said gap and held by said ribs.

2. A form as set forth in claim 1, wherein said first pair of ribs is coupled to the rear side.

3. A form as set forth in claim 2, wherein said frame includes a top rail, a bottom rail parallel to said top rail, and a pair of end rails, said pair of ribs being substantially parallel to said top rail.

4. A form as set forth in claim 3, wherein said end rails are substantially parallel to one another and define a width of the rear side therebetween, said pair of rails extending substantially the width of said rear side.

5. A form as set forth in claim 1, wherein said frame includes a top rail, a bottom rail parallel to said top rail, and a pair of end rails, said top rail and bottom rail each including at least a first set of holes and a second set of holes, the first set of said holes of said top rail being positioned substantially opposite the first set of holes of said bottom rail and the second set of holes of said top rail being positioned substantially opposite the second set of holes of said bottom rail, each of said sets of holes including a plurality of holes.

6. A form as set forth in claim 1, including an opening extending through the face plate and aligned with said gap.

7. A form as set forth in claim 1, including a second pair of first and second elongated metal ribs mounted to said face plate and extending into said rear area, said ribs of said second pair of ribs each including an inner margin coupled to the face plate and a free margin extending into the rear area, said first rib of said second pair of ribs being positioned substantially parallel to and adjacent said second rib of said second pair of ribs and separated by a gap of less than about 25 centimeters whereby said ribs of said second pair may grip objects positioned therebetween.

8. A form as set forth in claim 7, wherein said second pair of ribs is oriented substantially parallel to said first set of ribs.

9. A form as set forth in claim 8, including a third pair of first and second elongated metal ribs mounted to said face plate and extending into said rear area, said third pair of ribs being oriented substantially parallel to said second pair of ribs.

10. A form as set forth in claim 1, including a first stake hanger coupled to said face plate and extending into said rear area and a second stake hanger coupled to said face plate and extending into said rear area, said second stake hanger being aligned with and spaced from said first stake hanger, each of said hangers including an opening sized and oriented whereby a stake may pass through the openings and held by said hangers.

11. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap, said first pair of ribs being coupled to the rear side, at least one of said ribs including an elongated slot, and further including a metal rod of a greater hardness than said rib received in said slot.

12. A form as set forth in claim 11, wherein said rod is shiftably carried within the slot of said at least one rib for longitudinal movement along said slot.

13. A form as set forth in claim 11, wherein each of said first and second ribs includes an elongated slot communicating with said gap, each slot of said first and second ribs including a metal rod received in a respective one of said slots, said metal rod being of a hardness greater than the hardness of said rib.

14. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap, including an opening extending through the face plate and aligned with said gap, said opening receiving therein a plug having a body sized corresponding to said opening and at least one wing extending into said gap and sized for gripping by said first and second ribs.

15. A form as set forth in claim 14, wherein said plug is of metal.

16. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap, said frame including a top rail, a bottom rail parallel to said top rail, and a pair of end rails, said top rail and bottom rail each including at least a first set of holes and a second set of holes, the first set of said holes of said top rail being positioned substantially opposite the first set of holes of said bottom rail and the second set of holes of said top rail being positioned substantially opposite the second set of holes of said bottom rail, each of said sets of holes including a plurality of holes, said holes being positioned on said rails to be in a plane rearward of the free margin of said ribs.

17. A form as set forth in claim 16, including an elongated stake extending through one of the holes of said first set of holes in the top rail and one of the holes of said first set of holes in the bottom rail.

18. A form as set forth in claim 17, including a wedge received in said gap and engaged by said ribs.

19. A form as set forth in claim 18, wherein said wedge includes a top surface and a bottom surface respectively engaged by said first and second ribs, a substantially linear front edge positioned adjacent said rear side, and a back edge obliquely angled relative to said front edge.

20. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap, further including a first stake hanger coupled to said face plate and extending into said rear area and a second stake hanger coupled to said face plate and extending into said rear area, said second stake hanger being aligned with and spaced from said first stake hanger, each of said hanger including an opening sized and oriented whereby a stake may pass through the openings and held by said hangers, the opening of said first stake hanger having an elastomeric grommer.

21. A form for forming a cement structure from a pourable cementatious material received thereagainst, said form comprising:

a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grip objects positioned between the first pair of ribs in said gap, said frame including at least one reinforcing hat adjacent the rear side of the face plate, and wherein said first pair of first and second ribs are integrally formed with said reinforcing hat.

22. A form as set forth in claim 21, wherein said hat includes a first sidewall and a second sidewall and wherein said first pair of ribs is positioned adjacent said first sidewall and including a second pair of first and second ribs substantially parallel spaced apart ribs adjacent said second sidewall.

23. A forming system for forming a concrete structure comprising:

first and second forming panels, at least one of said first and second forming panels comprising a metal face plate having a front, cement receiving side, a rear side, and a surrounding frame extending rearwardly from the rear side to define a rear area bordered by said rear side and said frame; and a first pair of first and second elongated metal ribs mounted to said face plate and extending into said rear area, said ribs each including an inner margin coupled to the face plate and a free margin extending into the rear area, said first rib being positioned substantially parallel to and adjacent said second rib and separated by a gap of less than about 25 centimeters whereby said ribs may grin objects positioned between the first pair of ribs in said gap, said first and second forming panels being positioned in opposed, spaced relationship to one another and defining a concrete pouring area therebetween;

first and second anchors respectively connected to said first and second forming panels and located in said concrete pouring area;

a cable connected between said anchors; and at least one fastener engaged with one of said anchors and passing through said face plate of said at least one form into the gap between said ribs, said ribs gripping and retaining said fastener.

* * * * *